US010537172B2

(12) United States Patent
Lin

(10) Patent No.: US 10,537,172 B2
(45) Date of Patent: Jan. 21, 2020

(54) SINGLE-COLUMN CONFERENCE TABLE

(71) Applicant: JIANGYIN KAO YI MECHANIZATION INDUSTRY CO., LTD., Jiangsu (CN)

(72) Inventor: Yen-Chun Lin, Tainan (TW)

(73) Assignee: Jiangyin Kao Yi Mechanization Industry Co., Ltd., Jiangyin, Jiangsu (CN)

( * ) Notice: Subject to any disclaimer, the term of this patent is extended or adjusted under 35 U.S.C. 154(b) by 0 days.

(21) Appl. No.: 16/210,342

(22) Filed: Dec. 5, 2018

(65) Prior Publication Data

US 2019/0191866 A1 Jun. 27, 2019

(30) Foreign Application Priority Data

Dec. 25, 2017 (CN) ..... 2017 2 1832651 U

(51) Int. Cl.

| | |
|---|---|
| ***A47B 9/04*** | (2006.01) |
| ***A47B 13/02*** | (2006.01) |
| ***A47B 9/20*** | (2006.01) |
| *A47B 13/00* | (2006.01) |

(52) U.S. Cl.

CPC ..... *A47B 9/04* (2013.01); *A47B 9/20* (2013.01); *A47B 13/023* (2013.01); *A47B 2013/006* (2013.01)

(58) Field of Classification Search

CPC ..... A47B 9/10; A47B 9/20; A47B 13/023; A47B 2013/006

USPC ..... 108/146, 147, 147.19; 248/404

See application file for complete search history.

(56) References Cited

U.S. PATENT DOCUMENTS

| | | | | | |
|---|---|---|---|---|---|
| 3,210,135 | A * | 10/1965 | Goller | A47B 9/20 | 384/55 |
| 3,447,645 | A * | 6/1969 | Sautter | A47B 9/10 | 188/269 |
| 3,521,341 | A * | 7/1970 | Hornlein | A47B 9/20 | 248/161 |
| 3,825,244 | A * | 7/1974 | Bauer | A47B 9/10 | 267/124 |
| 5,443,573 | A * | 8/1995 | Thiele | A47B 9/10 | 248/161 |
| 6,182,583 | B1 * | 2/2001 | Larson | A47B 9/10 | 108/147 |
| 6,189,843 | B1 * | 2/2001 | Pfister | A47B 9/083 | 248/157 |

(Continued)

*Primary Examiner* — Jose V Chen

(74) *Attorney, Agent, or Firm* — Rosenberg, Klein & Lee

(57) ABSTRACT

A single-column conference table includes a base, a table top, and a lifting mechanism. The lifting mechanism includes an upright column having a bottom portion fixed to the base. A first accommodating chamber is defined inside the upright column. A lifting sleeve is provided in the first accommodating chamber. A second accommodating chamber is defined inside the lifting sleeve. The lifting sleeve is fixed to the table top. A driving unit is provided in the second accommodating chamber. The driving unit is a gas spring. A bottom of the gas spring is fixed to the base together with the upright column. A top of the gas spring is fixed to the support seat. The table top connected with the support seat can be lifted or lowered through the gas spring. The conference table is more stable and reliable during the lifting operation and can prevent the table top from rotating.

4 Claims, 4 Drawing Sheets

(56) References Cited

U.S. PATENT DOCUMENTS

| | | | | |
|---|---|---|---|---|
| 6,378,816 | B1 * | 4/2002 | Pfister | A47B 9/083<br>248/157 |
| 6,397,761 | B1 * | 6/2002 | Moore | A47B 9/10<br>108/147 |
| 6,402,102 | B1 * | 6/2002 | Sendfeld | A47B 9/10<br>248/157 |
| 8,733,712 | B2 * | 5/2014 | Xu | F16M 11/041<br>248/161 |
| 2002/0043597 | A1 * | 4/2002 | Forsberg | A47B 9/04<br>248/188.8 |
| 2002/0050112 | A1 * | 5/2002 | Koch | A47B 9/20<br>52/651.07 |
| 2004/0129844 | A1 * | 7/2004 | Doyle | A47B 9/04<br>248/188.8 |
| 2010/0207351 | A1 * | 8/2010 | Klieber | B62K 19/36<br>280/278 |
| 2011/0139957 | A1 * | 6/2011 | Friesen | A47B 9/10<br>248/634 |
| 2014/0360415 | A1 * | 12/2014 | Riis | A47B 9/20<br>108/147.19 |
| 2015/0164218 | A1 * | 6/2015 | Bonuccelli | A47B 9/20<br>108/147.19 |
| 2016/0037907 | A1 * | 2/2016 | Ergun | A47B 9/12<br>108/147 |
| 2016/0088930 | A1 * | 3/2016 | Hansen | F16F 9/0245<br>108/147 |
| 2017/0020279 | A1 * | 1/2017 | Ergun | A47B 9/02 |
| 2017/0238697 | A1 * | 8/2017 | Randlov | A47B 9/20 |
| 2018/0140087 | A1 * | 5/2018 | Wu | A47B 9/20 |
| 2018/0202476 | A1 * | 7/2018 | Wu | F16B 7/14 |

* cited by examiner

SINGLE-COLUMN CONFERENCE TABLE

FIELD OF THE INVENTION

The present invention relates to office supplies, and more particularly to a single-column conference table which can be vertically lifted or lowered stably and does not rotate arbitrarily.

BACKGROUND OF THE INVENTION

In general, a table has a certain height and cannot be adjusted in height. Due to the limited height of use, its practicality is reduced greatly, and it is not ergonomic. In order to meet the height requirement of the table for different users, many manufacturers have developed tables with lifting mechanisms (such as conference tables, etc.). At present, there are two ways to lift office table tops (such as conference tables) and dining tables used for hospital beds. One is realized by using a gas spring in cooperation with a locking mechanism. The table top is pulled to a certain height by an external force and then fixed by the locking mechanism. The other is realized by using a gas spring in cooperation with a serrated device. This lifting way is performed only at a predetermined position of the serrated device. The above two ways have certain limitations. In the process of actual use, the table top is not fixed firmly and often shakes. Moreover, the phenomenon of jamming is likely to occur during the lifting operation. The guiding effect is poor. The table top may rotate relative to the base, which brings a lot of inconvenience to users.

SUMMARY OF THE INVENTION

In view of the technical problem of the prior art, the primary object of the present invention is to provide a single-column conference table that can be lifted or lowered smoothly and is more stable and reliable during the lifting operation and can prevent the table top from rotating.

The technical solution adopted by the present invention is described below. A single-column conference table includes a base, a table top, and a lifting mechanism. The lifting mechanism includes an upright column having a bottom portion fixed to the base. A first accommodating chamber is defined inside the upright column. A lifting sleeve is provided in the first accommodating chamber. A second accommodating chamber is defined inside the lifting sleeve. A top end of the upright column extends inwardly to form a limiting ring. A bottom end of the lifting sleeve is provided with a C-shaped buckle to cooperate with the limiting ring. A top end of the lifting sleeve is provided with a support seat. The support seat is fixedly connected to the table top. A driving unit is provided in the second accommodating chamber. The driving unit is a gas spring. A bottom of the gas spring is fixed to the base together with the upright column. A top of the gas spring is fixedly connected to the support seat. The table top connected with the support seat can be lifted or lowered through the gas spring.

Preferably, a steel ball sleeve is provided between the upright column and the lifting sleeve. A steel ball of the steel ball sleeve is in contact with an inner wall of the upright column and an outer wall of the lifting sleeve, thereby preventing the steel ball sleeve from coming off through a C-shaped buckle at a bottom of the lifting sleeve.

Preferably, a wall of the upright column is formed with a through groove. The through groove is provided with a bearing. The bearing is secured in the through groove through a bearing press plate mounted on an outer wall surface of the upright column. An outer wall surface of the lifting sleeve is formed with a milled plane matching a rolling surface of the bearing. A rolling direction of the bearing is consistent with a lifting direction of the lifting sleeve.

Preferably, the gas spring is a lockable gas pressure rod.

Compared with the prior art, the present invention preferably has the following advantages:

1. The conference table with the single upright column reduces the space occupied and has a wider range of use.
2. The single gas spring is used for lifting and lowering the table top, which is simpler and more practical than the conventional lifting mechanism.
3. The lifting sleeve in the lifting mechanism cooperates with the single upright column through the steel ball sleeve. The sliding friction becomes rolling friction, which makes the lifting operation smoother and less prone to jamming.
4. The bearing is provided between the lifting sleeve and the single upright column. The bearing is in the same direction as the lifting direction. The outer wall surface of the lifting sleeve is formed with the milled plane matching the rolling surface of the bearing. Through the interference between the milled plane and the surface of the bearing, the lifting sleeve can only move up and down, thereby preventing relative rotation between the lifting sleeve and the upright column and making the table top more stable.

DETAILED DESCRIPTION OF THE PREFERRED EMBODIMENTS

Figure 1:
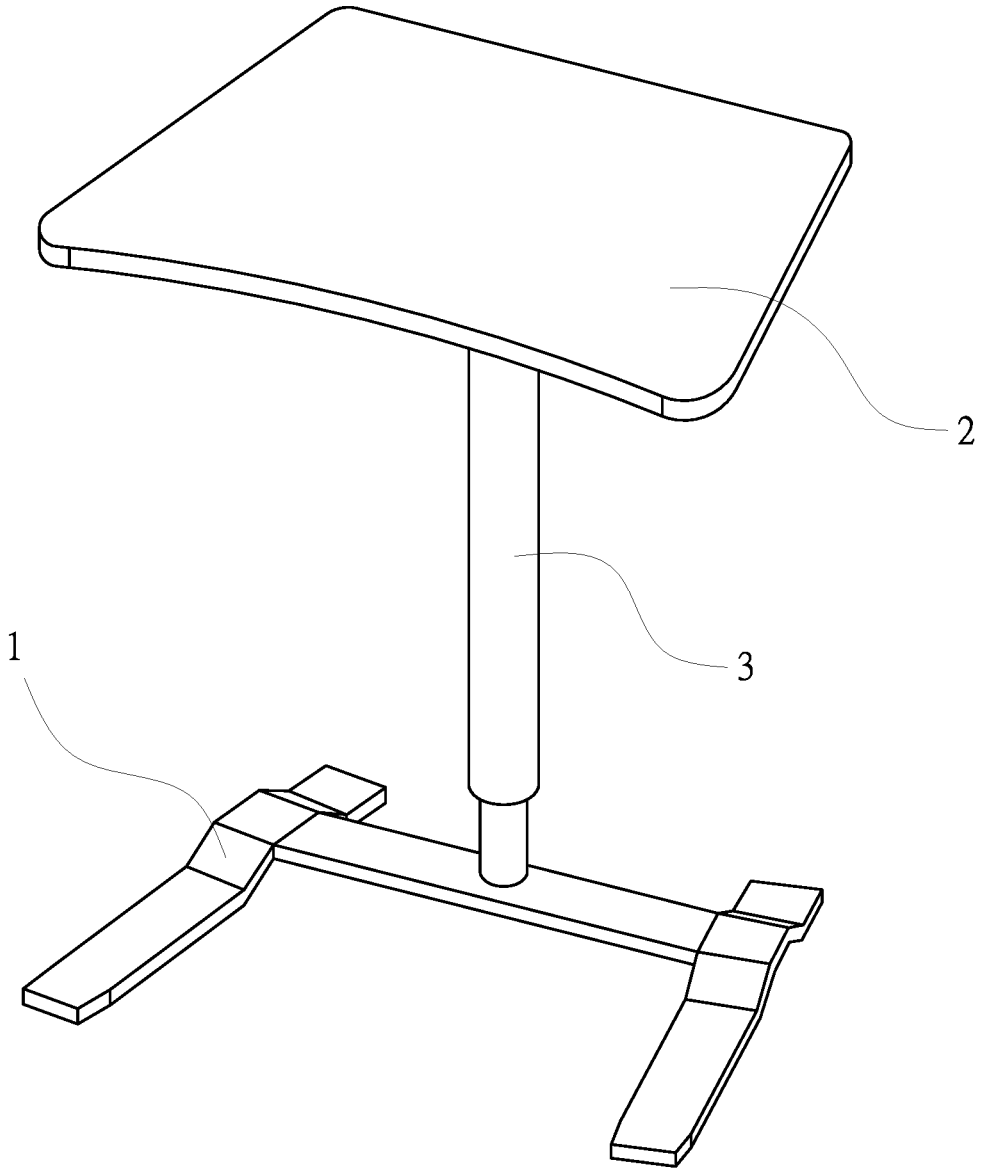
FIG. 1 is a perspective view in accordance with an embodiment of the present invention.
Figure 2:
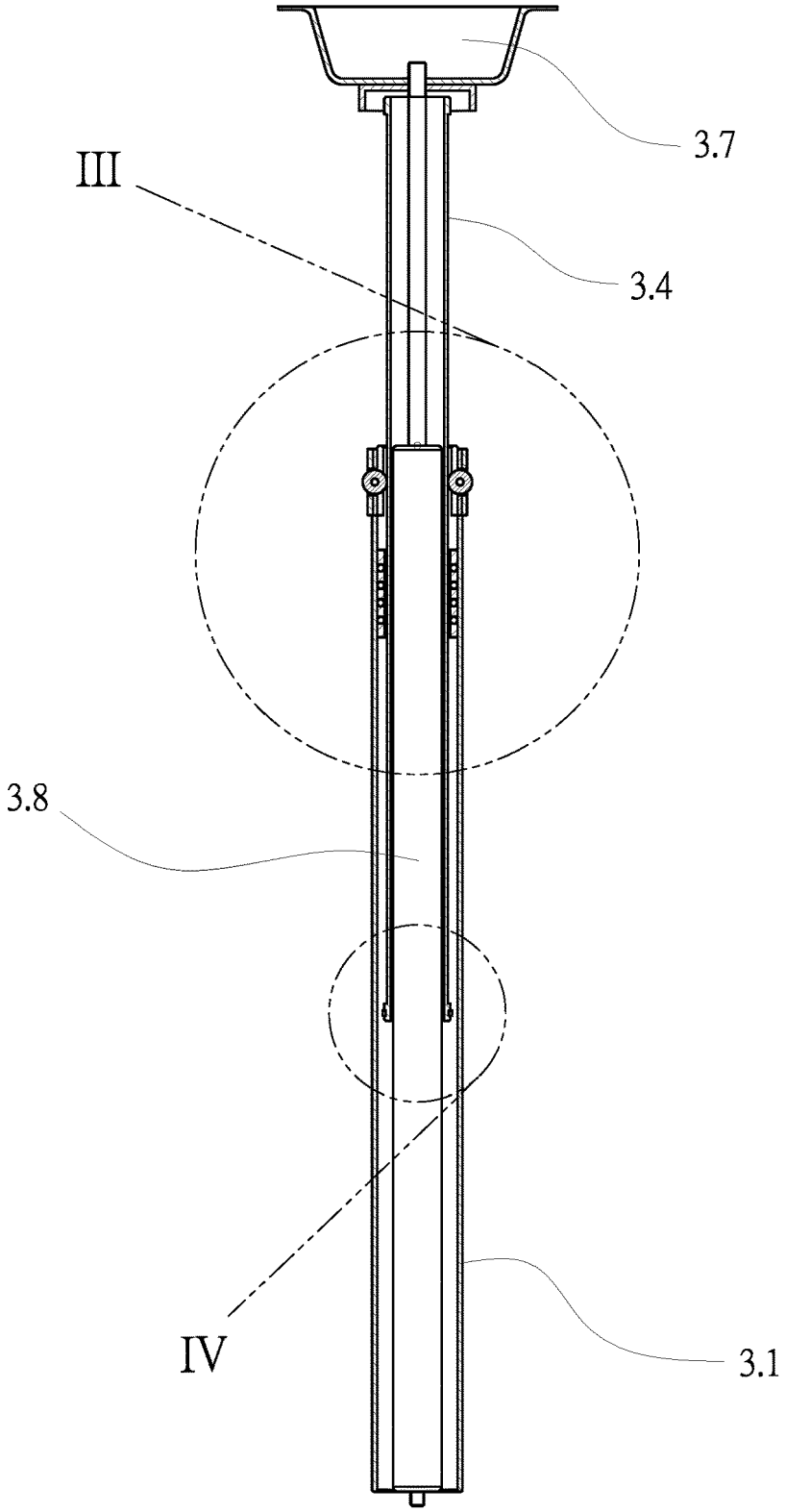
FIG. 2 is a cross-sectional view of the lifting mechanism in accordance with the embodiment of the present invention.

As shown in FIG. 1 and FIG. 2, a single-column conference table according to an embodiment of the present invention includes a base (1), a table top (2), and a lifting mechanism (3). The lifting mechanism (3) is installed between the base (1) and the table top (2) to implement height adjustment of the table top (2).

Figure 3:
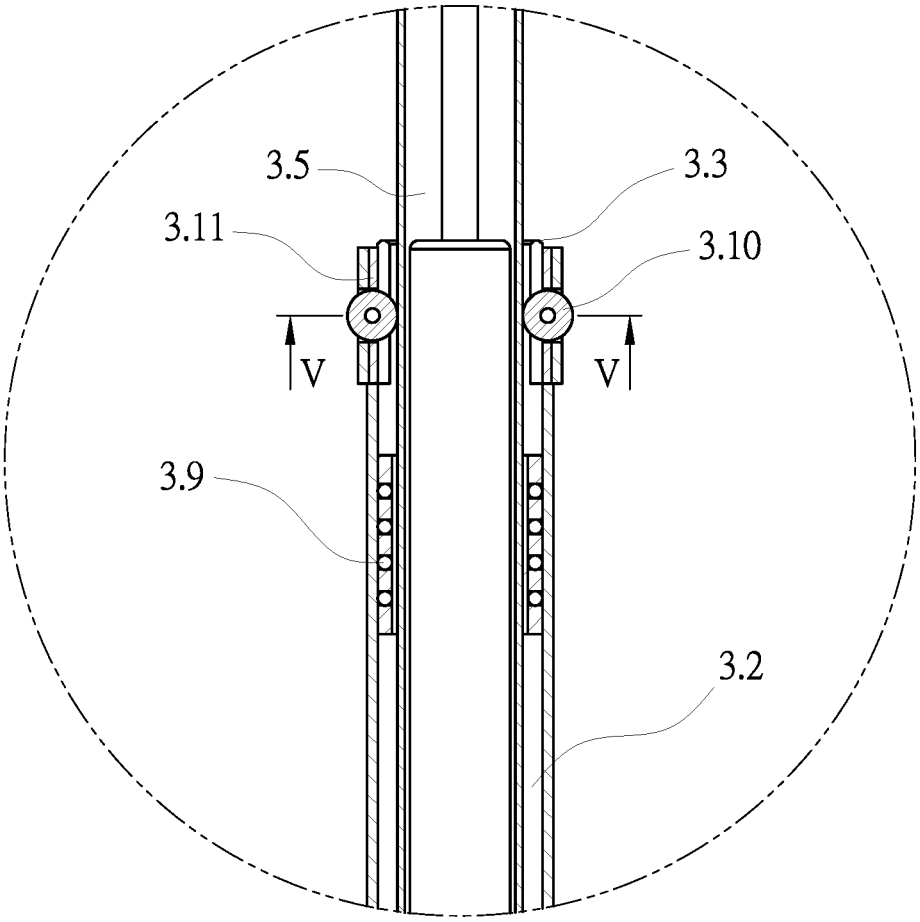
FIG. 3 is an enlarged view of the circled area III of FIG. 2.

Wherein, the lifting mechanism (3) includes a single upright column (3.1) having a bottom portion fixed to the base (1). The upright column (3.1) is tubular, and a first accommodating chamber (3.2) is defined inside the upright column (3.1) (as shown in FIG. 3). A top end of the upright column (3.1) extends inwardly to form a limiting ring (3.3).

Figure 4:
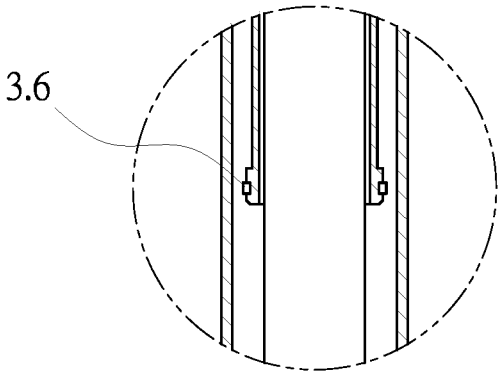
FIG. 4 is an enlarged view of the circled area IV of FIG. 2.

A lifting sleeve (3.4) is provided in the first accommodating chamber (3.2) of the upright column (3.1). The lifting sleeve (3.4) is tubular, and a second accommodating chamber (3.5) is defined inside the lifting sleeve (3.4) (as shown in FIG. 3). A bottom end of the lifting sleeve (3.4) is a free end that can be lifted or lowered. The outer wall of the bottom end of the lifting sleeve (3.4) is provided with a C-shaped buckle (3.6) (as shown in FIG. 4). The C-shaped buckle (3.6) cooperates with the limiting ring (3.3) to prevent the lifting sleeve (3.4) from coming off the first accommodating chamber (3.2) of the upright column (3.1), thereby limiting the lifting height of the lifting mechanism (3). A top end of the lifting sleeve (3.4) is provided with a support seat (3.7). The support seat (3.7) is fixedly connected to the table top (2). The diameter of the bottom of the support seat (3.7) is greater than the diameter of the first accommodating chamber (3.2), thereby controlling the lowest position of the table top (2).

A driving unit is provided in the second accommodating chamber (3.5) of the lifting sleeve (3.4). The driving unit is a gas spring (3.8). The bottom of the gas spring (3.8) is fixed to the base (1) together with the upright column (3.1), and the top of the gas spring (3.8) is fixedly connected to the support seat (3.7). The table top (2) connected with the support seat (3.7) is lifted or lowered by the action of the gas spring (3.8). The gas spring (3.8) is a lockable gas pressure rod.

In order to ensure the smooth lifting of the lifting mechanism (3), a steel ball sleeve (3.9) is provided between the upright column (3.1) and the lifting sleeve (3.4) (as shown in FIG. 3). The steel ball sleeve (3.9) is fitted on the lifting sleeve (3.4) and prevented from coming off through the C-shaped buckle (3.6) at the bottom of the lifting sleeve (3.4). Since the steel balls of the steel ball sleeve (3.9) are in contact with the inner wall of the upright column (3.1) and the outer wall of the lifting sleeve (3.4), the steel balls play a rolling driving action when the lifting sleeve (3.4) is lifted or lowered, such that the table top can be lifted or lowered smoothly, being less likely to be jammed.

Figure 5:
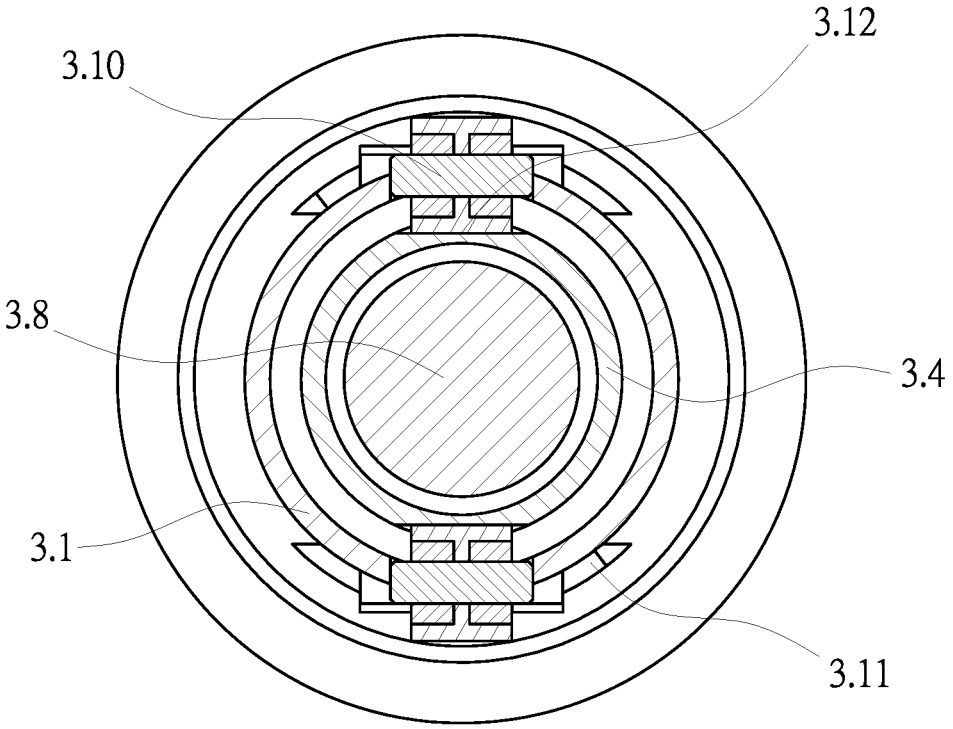
FIG. 5 is a cross-sectional view taken along line V-V of FIG. 3.

Since the single upright table (3.1) is used to support the table top (2) and the upright column (3.1) and the lifting sleeve (3.4) are coaxially disposed, the table top (2) is prone to rotate during the actual use, affecting the normal use of the conference table. As shown in FIG. 5, the wall of the upright column (3.1) is formed with a through groove, and a laterally arranged bearing (3.10) is provided in the through groove. The bearing (3.10) is secured in the through groove through a bearing press plate (3.11) mounted on the outer wall surface of the upright column (3.1). The outer wall surface of the lifting sleeve (3.4) is formed with a milled plane (3.12) matching the rolling surface of the bearing (3.10). Due to the interference between the milled plane (3.12) and the surface of the bearing (3.10), the lifting sleeve (3.4) can only move up and down, but cannot rotate along the central axis relative to the upright column (3.1). Besides, the rolling direction of the bearing (3.10) is consistent with the lifting direction of the lifting sleeve (3.4). This prevents relative rotation between the lifting sleeve (3.4) and the upright column (3.1), making the table top (2) of the conference table more stable.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A single-column conference table, comprising:

a base;

a table top; and a lifting mechanism, the lifting mechanism including an upright column having a bottom portion fixed to the base, a first accommodating chamber being defined inside the upright column, a lifting sleeve being disposed in the first accommodating chamber, a second accommodating chamber being defined inside the lifting sleeve, a top end of the lifting sleeve being fixedly connected to the table top, a driving unit being disposed in the second accommodating chamber, the driving unit being a gas spring, a bottom of the gas spring being fixed to the base together with the upright column, a top of the gas spring being fixedly connected to a support seat disposed at the top end of the lifting sleeve, the table top being fixedly connected with respect to the support seat and thereby being lifted or lowered through the gas spring;

wherein a top end of the upright column extends inwardly to form a limiting ring, a bottom end of the lifting sleeve has a buckle disposed thereon, at least the limiting ring blocks the buckle from leaving the first accommodating chamber, and the lifting sleeve is thereby prevented from disengaging the upright column.

2. The single-column conference table as claimed in claim 1, wherein a steel ball sleeve is disposed in the first accommodating chamber between the upright column and the lifting sleeve, and a steel ball of the steel ball sleeve contacts both an inner wall of the upright column and an outer wall of the lifting sleeve, the steel ball sleeve is thereby prevented from being displaced from the first accommodating chamber of the upright column by the buckle disposed at the bottom end of the lifting sleeve.

3. The single-column conference table as claimed in claim 1, wherein a wall of the upright column is formed with a through groove, a bearing is disposed in the through groove and is secured in the through groove by a bearing press plate mounted on an outer wall surface of the upright column, an outer wall surface of the lifting sleeve is formed with a milled surface matching a rolling surface of the bearing, the lifting sleeve only moves up and down and is prevented from rotating relative to the upright column by contact between the milled surface of the lifting sleeve and the corresponding rolling surface of the bearing, and a rolling direction of the bearing corresponds to a lifting direction of the lifting sleeve.

4. The single-column conference table as claimed in claim 1, wherein the gas spring is a lockable gas pressure rod.

* * * * *